US007168875B1

(12) United States Patent
Zhang et al.

(10) Patent No.: US 7,168,875 B1
(45) Date of Patent: Jan. 30, 2007

(54) MULTIPLE-FUNCTION COSMETIC PENS

(75) Inventors: Jun Zhang, Sijhih (TW); Li-Mei Liu, Sijhih (TW)

(73) Assignee: Chuen Chern Co., Ltd., Jhonghe (TW)

( * ) Notice: Subject to any disclaimer, the term of this patent is extended or adjusted under 35 U.S.C. 154(b) by 4 days.

(21) Appl. No.: 11/194,320

(22) Filed: Aug. 1, 2005

(51) Int. Cl.
*B43K 5/06* (2006.01)

(52) U.S. Cl. ..... 401/174; 401/172

(58) Field of Classification Search ..... 401/63, 401/64, 68, 69, 171–179, 277, 279
See application file for complete search history.

(56) References Cited

U.S. PATENT DOCUMENTS 6,227,739 B1 * 5/2001 Kageyama ..... 401/172
6,688,796 B1 * 2/2004 Liu ..... 401/174
6,918,515 B2 * 7/2005 Noguchi ..... 401/172

* cited by examiner

*Primary Examiner*—Tuan Nguyen
(74) *Attorney, Agent, or Firm*—Alan D. Kamrath; Nikolai & Mersereau, P.A.

(57) ABSTRACT

A cosmetic pen a hollow outer body and a hollow inner body with an applicator and a lip stick unit are respectively connected to two ends of the hollow outer body. A transmission unit is located between the sleeve of the lip stick unit an the inner body. The sleeve includes an exterior threaded section which is engaged with a cap so that when rotating the cap, the cosmetic liquid in the inner tube can be pushed out from the applicator. The lip stick unit includes a base with a spiral groove and a lip stick is connected to the base, a sleeve is engaged with the spiral groove so that the base can be moved axially by rotating the sleeve to use the lip stick.

10 Claims, 8 Drawing Sheets

MULTIPLE-FUNCTION COSMETIC PENS

FIELD OF THE INVENTION

The present invention relates to a multiple-function pen with a solid applicator such as a lip stick at one end and a liquid cosmetic substance such as eye-shadow or eye-liner at the other end.

BACKGROUND OF THE INVENTION

A conventional cosmetic pen is shown in FIGS. 7 and 8 and generally includes a cylindrical and hollow body 70 which includes a passage 71 and the passage 71 includes a section with a polygonal inner periphery 72 and a groove 73 which is located near a first end of the body 70. An applicator 74 is connected to a second end of the body 70 so that liquid cosmetic substance may flow from the applicator 74. A first cap 75 is mounted to the body 70 and received the applicator 74 therein. An action rod 76 axially and movably received in the body 70 and includes an exterior threaded section 77. A ring 78 is mounted to an end of the action rod 76 and engaged with the polygonal inner periphery 72. A rotatable member 80 is connected to the first end of the body 70 and includes a driving tube 81 which has an interior threaded section 82 so as to be engaged with the exterior threaded section n77 of the action rod 76. The rotatable member 80 has a flange 83 which is engaged with the groove 73 so that the rotatable member 80 is rotatably connected to the body 70. When in use, the cap 75 is removed first and the rotatable member 80 is rotated so that the driving tube 81 moves the action rod 76 axially in the passage 72 to push the cosmetic liquid toward the applicator 74.

However, each cosmetic pen includes only one cosmetic liquid which provides only one function so that the users have to prepare several cosmetic pens and this means the users need a large bag to receive all of the cosmetic pens.

The present invention intends to provide a multi-function cosmetic pen which includes two ends with a solid lip stick and a liquid cosmetic substance.

SUMMARY OF THE INVENTION

The present invention relates to a cosmetic pen that a hollow outer body and a hollow inner body which is received in a first end of the outer body. A lip stick unit is received in a second end of the outer body and includes a hollow sleeve and a driving member is rotatably connected to the sleeve. A base is connected between the driving member and the hollow sleeve. A first cap is removably mounted to the sleeve and has a first interior threaded section defined in an inner periphery thereof so as to be engaged with an exterior threaded section of the sleeve.

A transmission unit is received in the lip stick unit and has a threaded rod which is engaged with a threaded hole of a guide member. A section of the threaded rod is inserted into a passage defined axially in the base. A positioning member is mounted to the threaded rod and guides the threaded rod to move linearly. A piston is connected to the threaded rod so as to push cosmetic liquid in the inner body out from an applicator on an end of the inner body.

The primary object of the present invention is to provide a cosmetic pen that has a lip stick unit on one end and an applicator at the other end. The cosmetic pen can use both solid and liquid cosmetic substances.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
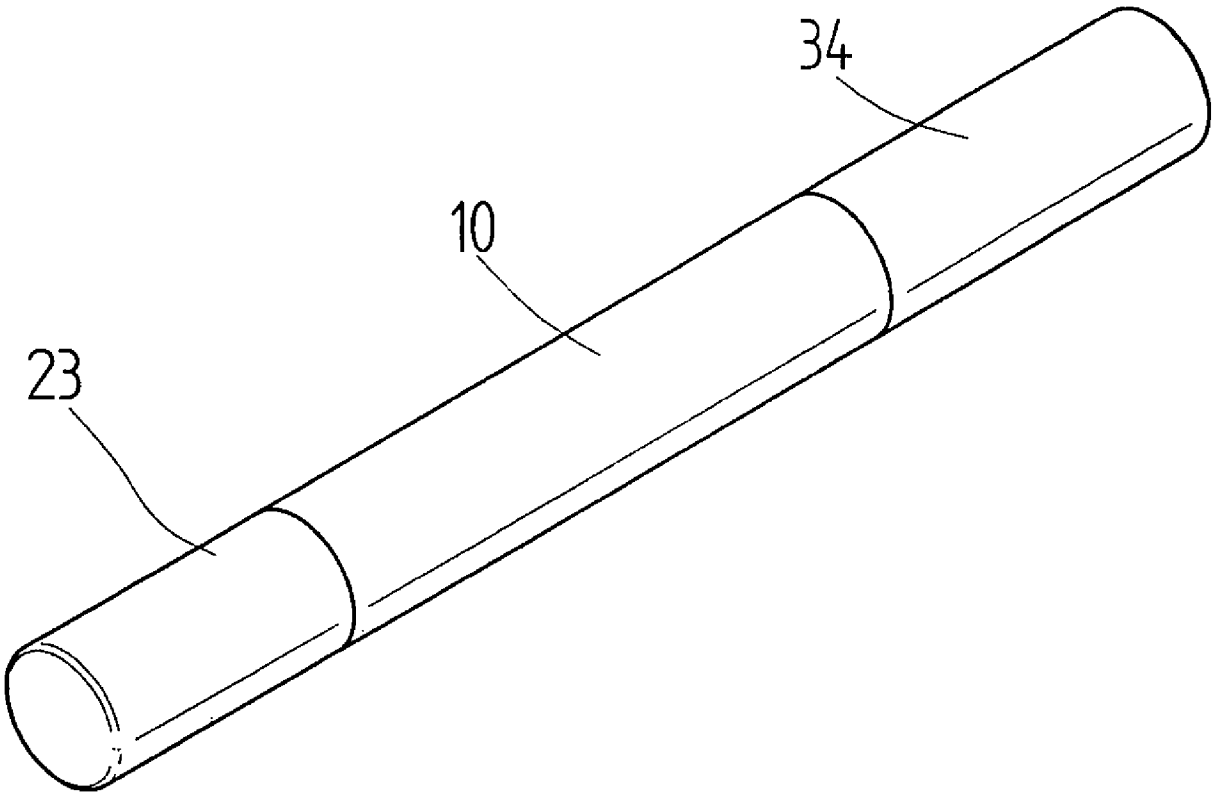
FIG. 1 is a perspective view to show the cosmetic pen of the present invention.
Figure 2:
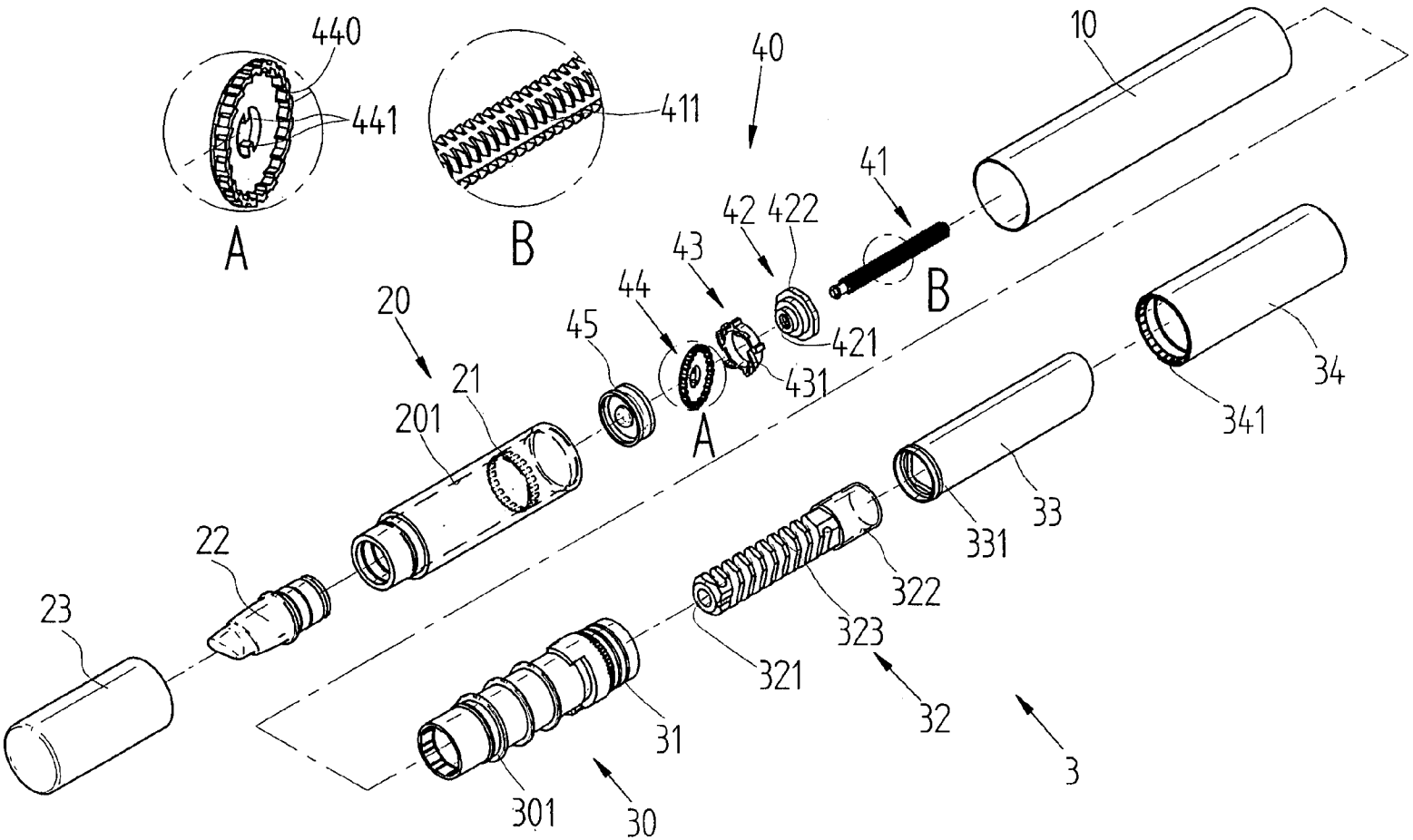
FIG. 2 is an exploded view to show the cosmetic pen of the present invention.
Figure 3:
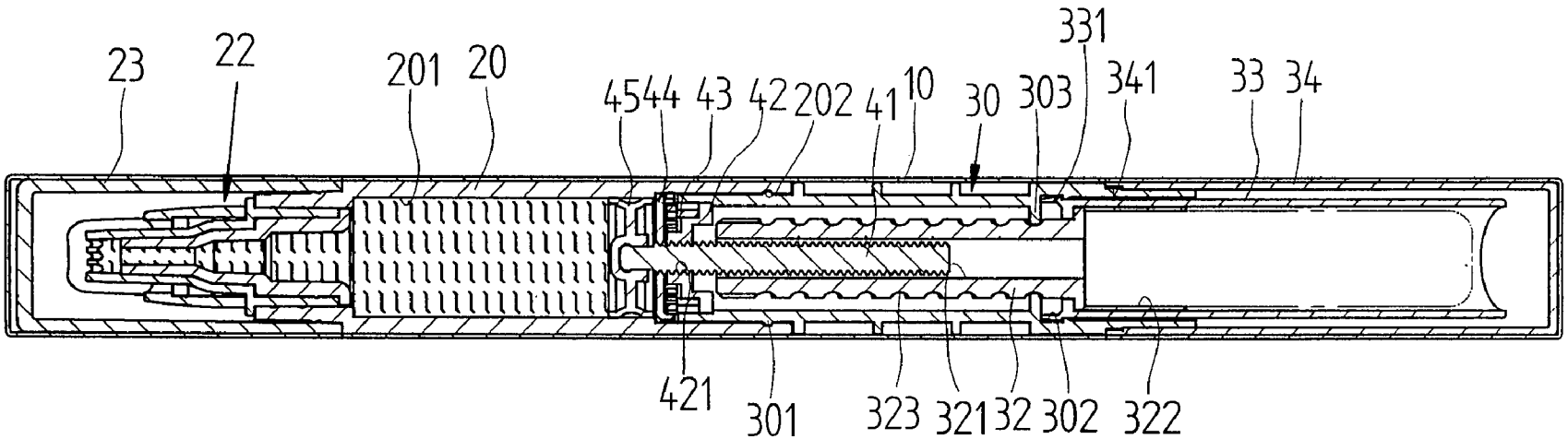
FIG. 3 is a cross sectional view of the cosmetic pen of the present invention.
Figure 4:
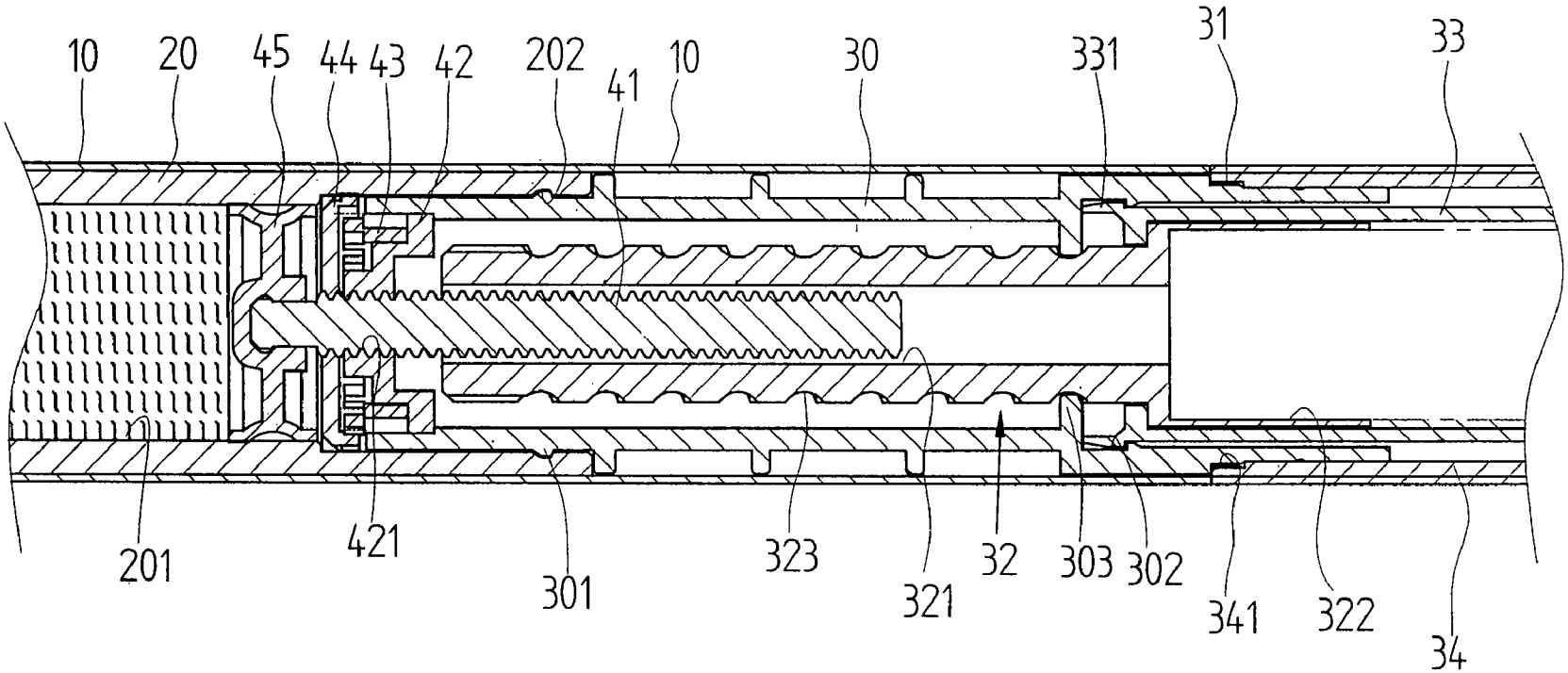
FIG. 4 is an enlarged partial view of the cross sectional view in FIG. 3.

Referring to FIGS. 1 to 4, the cosmetic pen of the present invention comprises a cylindrical hollow outer body 10 and a hollow inner body 20 is received in a first end of the outer body 10 and has a chamber 201 defined therein which further has a first toothed surface 21. A groove 202 is defined in an inner periphery of the chamber 201 in which liquid cosmetic substance is received. A lip stick unit 3 is received in a second end of the outer body 10 and includes a hollow sleeve 30 which includes a first exterior threaded section 31. A driving member 33 is rotatably connected to the sleeve 30 and a base 32 is connected between the driving member 33 and the hollow sleeve 30. The base 32 includes a recess 322 so as to receive a lip stick. The base 32 includes a passage 321 defined axially therein and a spiral groove 313. The sleeve 30 includes a guide member 303 which is engaged with the spiral groove 313. The driving member 33 has a positioning piece 331 and the sleeve 30 includes a shoulder 302 with which the positioning piece 331 is engaged. The sleeve 30 includes a flange 301 which is engaged with the groove 202. The inner body 20 includes an applicator 22 connected to an end opposite to the lip stick unit 3. A first cap 23 is mounted onto the inner body 20 and received the applicator 22 therein.

A second cap 34 is removably mounted to the sleeve 30 and has a first interior threaded section 341 defined in an inner periphery thereof so as to be engaged with the first exterior threaded section 31 of the sleeve 30.

A transmission unit 40 is received in the lip stick unit 3 and has a threaded rod 41 which is engaged with a threaded hole 421 of a guide member 42. The threaded rod 41 has a stop ring 43 mounted thereto and the guide member 42 includes a match surface 422 with which the stop ring 43 is matched. A section of the threaded rod 41 is inserted into the passage 321 in the base 32 and a positioning member 44 is mounted to the threaded rod 41. The threaded rod 41 includes two axial guide rails 411 and the positioning member 44 includes a toothed outer surface which is engaged with the first toothed surface 21 of the inner body 20. The positioning member 44 includes two guide blocks 441 at an inner periphery thereof and the guide blocks 441 are slidably engaged with the axial guide rails 411 of the threaded rod 41 so as to guide the threaded rod 41 to move linearly. A piston 45 is connected to an end of the threaded rod 41 so that when threaded rod 41 moves, the cosmetic liquid in the chamber 201 of the inner body 2 is pushed to flow out from the applicator 22. The positioning member 44 further has a concaved ratchet surface 440 which faces the stop ring 43. A plurality of ratchets are defined in an inner periphery of the concaved ratchet surface 440 and engaged with the toothed surface 431 in the stop ring 43.

Figure 5:
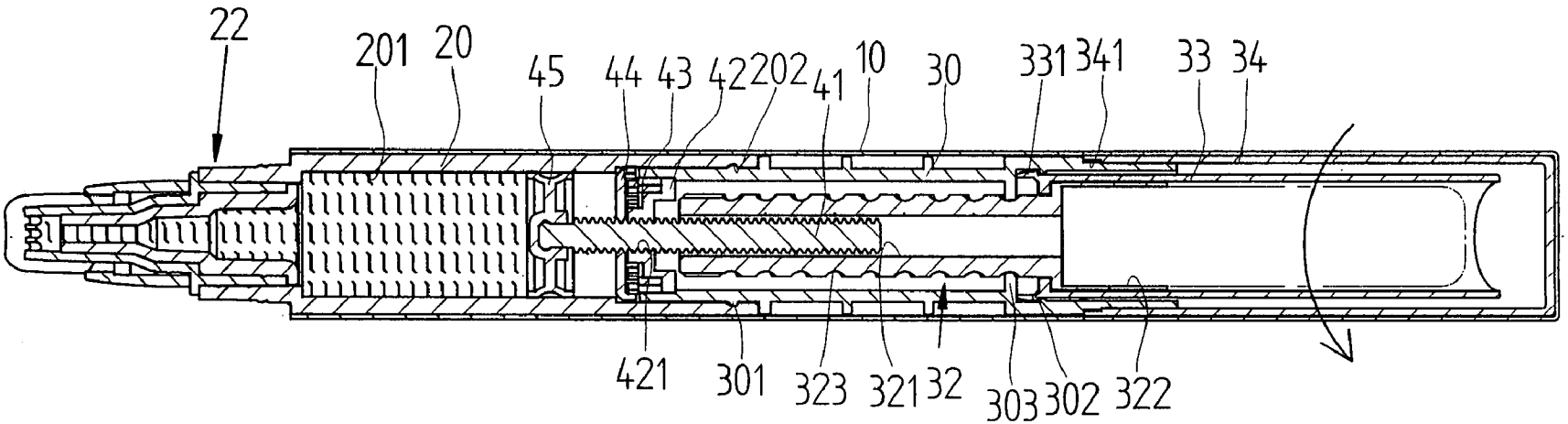
FIG. 5 shows the usage of the applicator of the cosmetic pen.

As shown in FIG. 5, when the user wants to use the cosmetic liquid by the applicator 22, removing the first cap 23 and the second cap 34 is mounted to the sleeve 30 and the first interior threaded section 341 of the second cap 34 is engaged with the first exterior threaded section 31 of the sleeve 30, then rotating the second cap 34 to rotate the sleeve 30 and the positioning member 44 of the transmission unit 40. The two guide blocks 441 of the positioning member 44 rotates the threaded rod 41 and the concaved ratchet surface 440 of the positioning member 44 is engaged with the toothed surface 431. The threaded hole 421 of the guide member 42 is engaged with the threaded rod 41 which is axially moved relative tot eh guide member 42 so as to move the piston 45 to force the cosmetic liquid substance in the inner tube 20 to flow out from the applicator 22.

Figure 6:
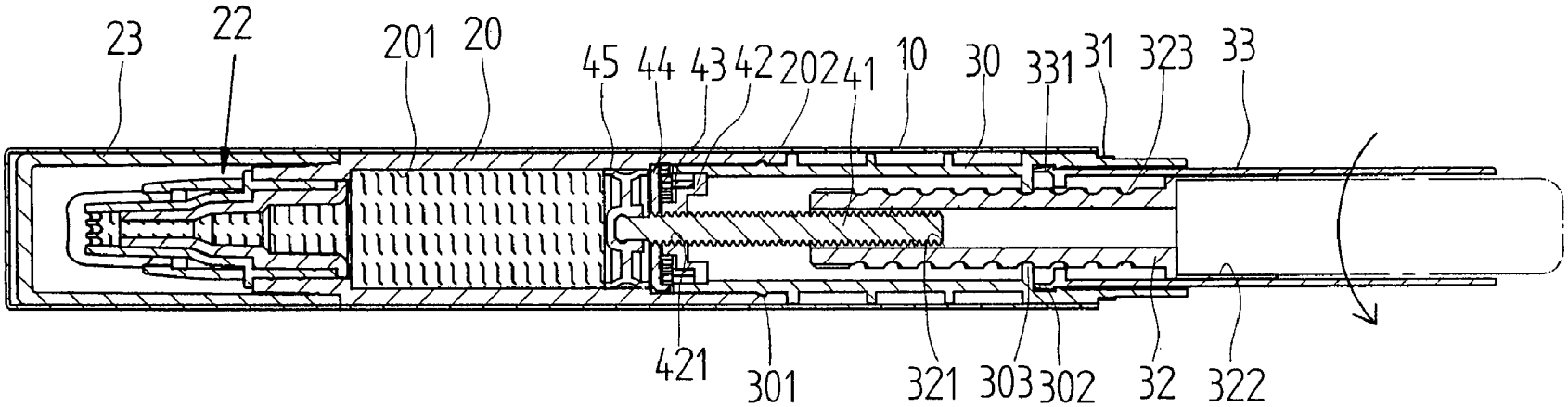
FIG. 6 shows the usage of the lip stick unit of the cosmetic pen.
Figure 7:
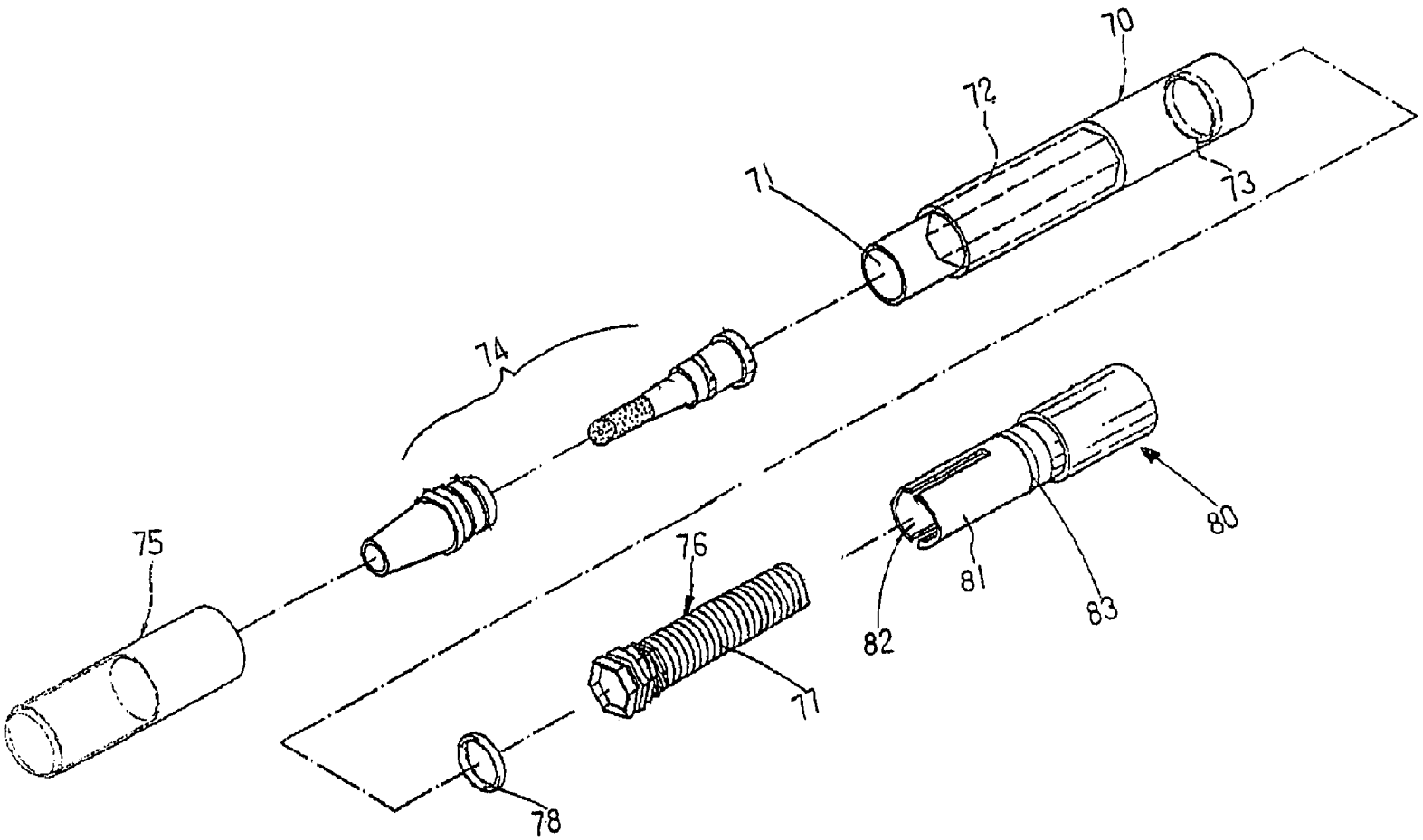
FIG.7 PRIOR ART
FIG. 7 is an exploded view to show a conventional cosmetic pen.
Figure 8:
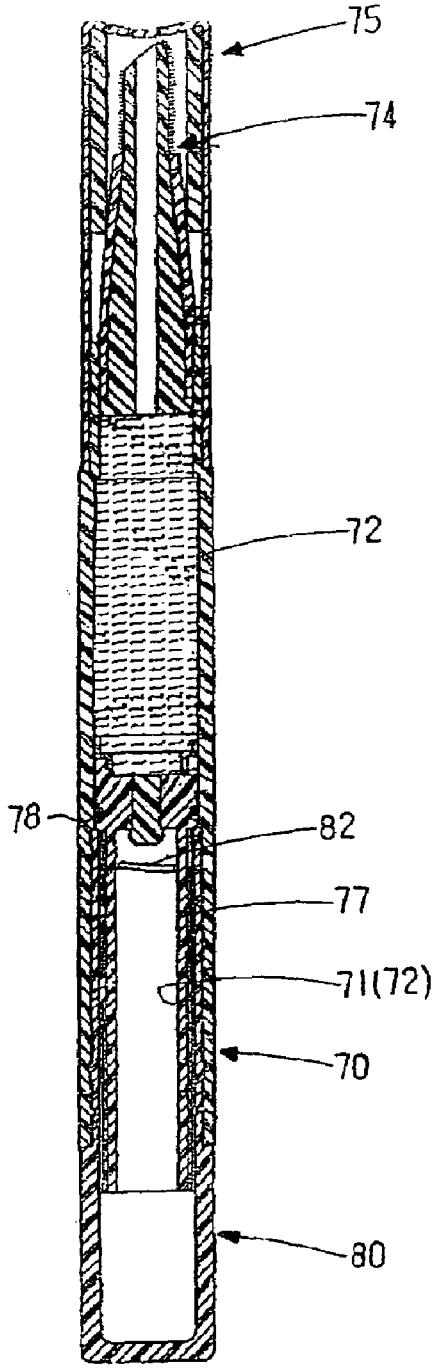
FIG.8 PRIOR ART
FIG. 8 is a cross sectional view of conventional cosmetic pen.

As shown in FIG. 6, removing the second cap 34 and the positioning piece 331 of the driving member 33 is engaged with the shoulder 302 of the sleeve 30, and the flange 301 of the sleeve 30 is engaged with the groove 202 of the inner body 20. When rotating the driving member 33, both of the driving member 33 and the sleeve 30 are rotated while no axial movement happens. The guide member 303 of the driving member 33 moves over the spiral groove 323 of the base 32 so that the base 32 moves axially and the lip stick engaged with the recess 322 of the base 32 is extended from the driving member 33.

While we have shown and described the embodiment in accordance with the present invention, it should be clear to those skilled in the art that further embodiments may be made without departing from the scope of the present invention.

What is claimed is:

1. A cosmetic pen comprising:

a hollow outer body;

a hollow inner body received in a first end of the outer body and having a chamber defined therein:

a lip stick unit received in a second end of the outer body and including a hollow sleeve which includes a first exterior threaded section, a driving member which is rotatably connected to the sleeve and a base connected between the driving member and the hollow sleeve, a first cap removably mounted to the sleeve and having a first interior threaded section defined in an inner periphery thereof so as to be engaged with the first exterior threaded section of the sleeve, and a transmission unit received in the lip stick unit and having a threaded rod which is engaged with a threaded hole of a guide member, a section of the threaded rod inserted into the a passage defined axially in the base, a positioning member mounted to the threaded rod and guiding the threaded rod to move linearly, a piston connected to the threaded rod.

2. The cosmetic pen as claimed in claim 1, wherein a groove is defined in an inner periphery of the chamber and the sleeve includes a flange which is engaged with the groove.

3. The cosmetic pen as claimed in claim 1, wherein the driving member has a positioning piece and the sleeve includes a shoulder with which the positioning piece is engaged.

4. The cosmetic pen as claimed in claim 1, wherein the base has a spiral groove and the sleeve includes a guide member which is engaged with the spiral groove.

5. The cosmetic pen as claimed in claim 1, wherein the chamber of the inner body includes a first toothed surface the threaded rod includes at least one axial guide rail, the positioning member includes a toothed outer surface which is engaged with the first toothed surface of the inner body, the positioning member includes at least one guide block at an inner periphery thereof and the at least one guide block is slidably engaged with the at least one axial guide rail of the threaded rod.

6. The cosmetic pen as claimed in claim 5, wherein the threaded rod includes two guide rails and the positioning member includes two guide blocks.

7. The cosmetic pen as claimed in claim 5, wherein the threaded rod has a stop ring mounted thereto and the guide member includes a match surface with which the stop ring is matched, the positioning member has a concaved ratchet surface which faces the stop ring, a plurality of ratchets are defined in an inner periphery of the concaved ratchet surface and engaged with the toothed surface in the stop ring.

8. The cosmetic pen as claimed in claim 1, wherein the inner body includes an applicator connected to an end opposite to the lip stick unit.

9. The cosmetic pen as claimed in claim 8, wherein a second cap is mounted onto the inner body and received the applicator therein.

10. The cosmetic pen as claimed in claim 1, wherein the base includes a recess which is adapted to receive a lip stick.

* * * * *